United States Patent [19]

Bröker et al.

[11] Patent Number: 4,741,680

[45] Date of Patent: May 3, 1988

[54] HIGH-PRESSURE PLUNGER PUMP WITH COAXIAL PRESSURE AND SUCTION VALVES

[75] Inventors: Erich Bröker, Bad Salzuflen; Paul Hammelmann, Zum Sundern 17, 4740 Oelde 1, both of Fed. Rep. of Germany

[73] Assignee: Paul Hammelmann, Oelde, Fed. Rep. of Germany

[21] Appl. No.: 879,135

[22] Filed: Jun. 26, 1986

[30] Foreign Application Priority Data

Jun. 29, 1985 [DE] Fed. Rep. of Germany ..... 3523387

[51] Int. Cl.[4] ..... F04B 21/02

[52] U.S. Cl. ..... 417/567; 417/571

[58] Field of Search ..... 417/457, 469, 567, 569, 417/559, 509, 571

[56] References Cited

U.S. PATENT DOCUMENTS

| | | | |
|---|---|---|---|
| 1,734,721 | 11/1929 | Frisch | 417/509 |
| 3,238,887 | 3/1966 | Volz | 417/569 X |
| 4,102,611 | 7/1978 | Bröker | 417/469 |
| 4,146,355 | 3/1979 | Bröker et al. | 417/457 X |
| 4,173,435 | 11/1979 | Hammelmann | 417/457 X |
| 4,174,194 | 11/1979 | Hammelmann | 417/567 |
| 4,616,983 | 10/1986 | Hanafi | 417/571 |

FOREIGN PATENT DOCUMENTS

| | | | |
|---|---|---|---|
| 2631217 | 1/1978 | Fed. Rep. of Germany | 417/457 |
| 880453 | 1/1943 | France | 417/469 |
| 212304 | 3/1924 | United Kingdom | 417/469 |

*Primary Examiner*—Carlton R. Croyle
*Assistant Examiner*—Paul F. Neils
*Attorney, Agent, or Firm*—Erwin S. Teltscher

[57] ABSTRACT

A high-pressure plunger pump includes a pump housing centered on an axis and including a main body having two axially spaced ends, and a pump head secured to one of the ends of the main body. A plunger coaxially extends into the pump housing and a sleeve is floatingly supported on the plunger. The sleeve has two end portions one of which is closer to the pump head than the other, converges toward the pump head and has an axial end face. An insert body is positionally secured in the pump housing at the one end portion of the sleeve and bounds a circumferentially extending annular suction channel with this one end portion. The insert body includes an annular shoulder having a substantially axially facing seating surface. Pressure and suction valves are coaxially arranged within the housing. The suction valve is constructed as a plate valve including an annular suction valve member movable toward and away from its closed position in which its outer and inner regions respectively sealingly contact the annular shoulder of the insert body and the axial end face of the sleeve. A spring urges the suction valve member towards its closed position. The contact surfaces of the inner and outer regions of the suction valve body with the sleeve and with the insert member may be axially offset from one another, and the suction valve member may have a tapered region between such surfaces.

8 Claims, 3 Drawing Sheets

HIGH-PRESSURE PLUNGER PUMP WITH COAXIAL PRESSURE AND SUCTION VALVES

BACKGROUND OF THE INVENTION

The present invention relates to pumps in general, and more particularly to a high-pressure plunger pump.

There are already known various constructions of plunger pumps, among them such in which a pressure valve and a suction valve are coaxially arranged in a pump housing which includes a main body and a pump head secured to one end of the main body, a plunger extends into the interior of the pump housing, and a sleeve is floatingly supported on the plunger and has one end portion which is closer to the pump head than the other and converges toward the pump head, and in which the suction valve is constructed as a plate valve including a spring-loaded annular suction valve body which is supported at the region of its outer edge on an annular surface of an insert body which is secured in position in the pump head.

A high-pressure plunger pump of this kind is known, for instance, from the published German patent application DE-AS No. 26 31 217, in which the insert body is provided with a concentrically extending row of flow passages, the central longitudinal axis of which approximately corresponds to the angle of inclination of the converging portion of the sleeve. The structural embodiment of this known high-pressure plunger pump had, in principle, quite successfully proven its merits in practical applications. However, as a result of the arrangement and configuration of the flow passages in the insert body, there are obtained output-reducing flow resistances, which stand in the way of an optimum employment of the high-pressure plunger pump. The manufacture of the insert body which is provided with the flow passages creates difficulties which are not negligible. The insert body is subjected during the operation to alternating loads. For this reason, it is necessary to manufacture this insert body with a high precision and a high surface quality. Moreover, wear phenomena occur at the region of the pressure valve or of the suction valve, such phenomena also deleteriously influencing the cost-effectivenes of the high-pressure plunger pump.

SUMMARY OF THE INVENTION

Accordingly, it is a general object of the present invention to avoid the disadvantages of the prior art.

More particularly, it is an object of the present invention to provide a high-pressure plunger pump which does not possess the drawbacks of the known pumps of this type.

It is yet another object of the present invention to design the pump of the type here under consideration in such a manner as to simultaneously reduce, while using structurally simple expedients, both the flow resistances at the region of the suction valve and the wear phenomena at the region of the suction valve and/or the pressure valve, and thus to improve the economy of the pump as a whole.

A concomitant object of the present invention is so to construct the pump of the above type as to be relatively simple in construction, inexpensive to manufacture, easy to use, and yet reliable in operation.

In keeping with these objects and others which will become apparent hereafter, one feature of the present invention resides in a high-pressure plunger pump which comprises a pump housing centered on an axis and including a main body having two axially spaced ends, and a pump head secured to one of the ends of the main body; a plunger coaxially extending into the pump housing; a sleeve floatingly supported on the plunger and having two end portions one of which is closer to the pump head than the other, converging toward the pump head and having an axial end face; an insert body positionally secured in the pump housing and bounding a circumferentially extending annular suction channel with the one end portion of the sleeve, and including an annular shoulder having a substantially axially facing seating surface; and pressure and suction valves coaxially arranged within the housing. The suction valve is constructed as a plate valve including an annular suction valve member having an outer and an inner edge region and movable between an open position and a closed position, said outer and inner edge regions respectively sealingly contact the annular shoulder of the insert body and the axial end face of the sleeve in said closed position, and spring means urges the suction valve member towards the closed position thereof.

As a result of the above-described construction of the high-pressure plunger pump, the flow-through cross-sectional area of the above-mentioned flow passage is significantly increased, which has the same significance as saying that the resistance to flow is reduced at this region and that the effectiveness is improved. In this context, it is particularly advantageous when the one end portion of the sleeve has a converging external surface and the insert body has an internal surface which bounds the suction channel with, and extends substantially parallel to, the external surface of the one end portion of the sleeve.

Wear reduction at the suction valve or the pressure valve also stands in a causal relationship with the reduction of the flow resistance at the region of the flow passage. Therefore, it is advantageous when there is further provided a guiding sleeve arranged in the insert body at a predetermined reciprocation region in which the suction valve member moves reciprocally between its open and closed positions, the insert body being slidingly contacted by the outer edge region of the suction valve member during its reciprocating movement. Advantageously, the guiding sleeve is of a material having a low coefficient of friction. This feature also contributes to the increase in the effectiveness of the high-pressure plunger pump, as does the already mentioned reduction of the flow resistance.

According to another advantageous facet of the present invention, the inner and outer edge regions of the suction valve member have respective inner and outer contact surfaces which respectively contact the axial end face of the sleeve and the seating surface of the shoulder of the insert body, the inner contact surface being offset with respect to the outer contact surface in the axial direction of the suction valve body, and the suction valve body having a tapered region extending between the inner and outer contact surfaces. The tapered region of the suction valve member may advantageously have an arcuate outer contour. It is particularly advantageous when the suction valve member has a flow-through opening having a predetermined diameter and when the suction valve member has an axial dimension substantially corresponding to the predetermined diameter. Last but not least, it is also of advantage when the one end portion of the sleeve has a substantially S-shaped configuration at the suction channel commencing at the axial end face thereof which cooperates with the suction valve member.

BRIEF DESCRIPTION OF THE DRAWING

The present invention will be described below in more detail with reference to the accompanying drawing in which.

DETAILED DESCRIPTION OF THE PREFERRED EMBODIMENTS

Figure 1:
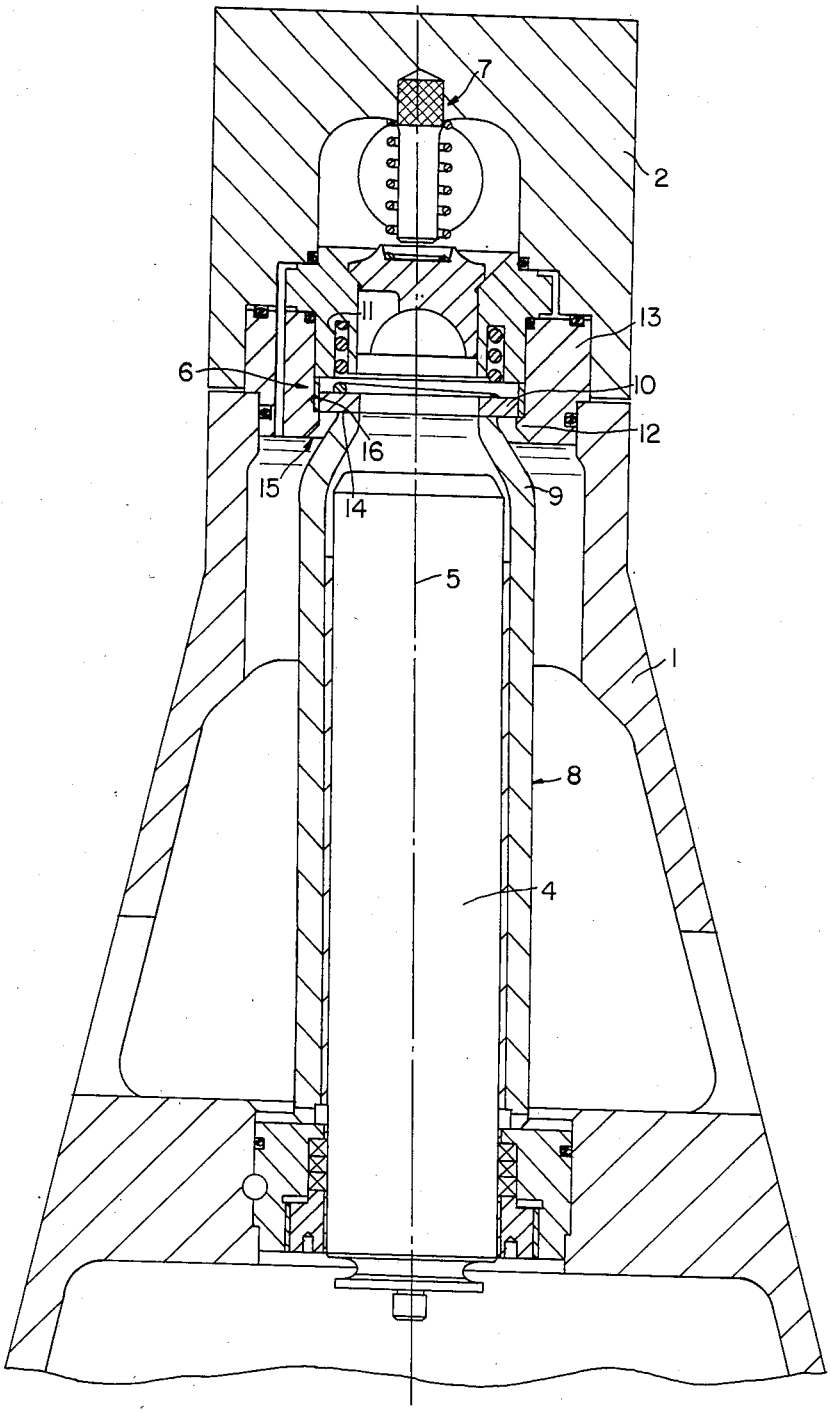
FIG. 1 is a longitudinal sectional view of a high-pressure plunger pump constructed in accordance with the present invention.

Referring now to the drawing in detail, and first to FIG. 1 thereof, it may be seen that it depicts a high-pressure plunger pump which includes, as its main components, a pump housing 1, a pump head 2 which is connected with the pump housing 1, a plunger 4, a suction valve 6 and a pressure valve 7 which are arranged coaxially with a cylinder axis 5, as well as a sleeve 8 that is floatingly supported on the plunger 4 and has an end portion 9 which is closer to the pump head 2 than its other end portion and converges toward the suction valve 6.

The suction valve 6 is constructed as a plate valve, including a suction valve member 10 which has an annular configuration and rests, due to a force exerted thereon by a compression spring 11, at the region of its outer edge against a shoulder 12 of an insert body 13 which is inserted into the pump head 2. The shoulder 12 forms an annular support surface for the suction valve member 10.

In a closing position of the suction valve 6 which is illustrated in FIG. 1 of the drawing, an inner edge region of the suction valve member 10 is in a sealing contact with an end face 14 of the converging end portion 9 of the sleeve 8. The insert body 13 is provided at its side which faces the sleeve 8 with a conical bore which is bounded by an inner surface that extends substantially parallel to the external surface of the converging end portion 9 of the sleeve 8.

Inasmuch as the diameter of the conical bore of the insert body 13 is in each instance larger than the correspondingly associated diameter of the sleeve 8, a circumferentially complete annular suction channel 15 is formed between the internal surface bounding the conical bore of the insert body 13 and the external surface of the converging end portion 9 of the sleeve 8.

In the construction of the plunger pump which is illustrated in FIG. 1 of the drawing, a guiding sleeve 16 is provided in the insert body 13 at the region of movement of the suction valve member 10. The guiding sleeve 16 is preferably made of a material with a low coefficient of friction. The suction valve member 10 slidingly engages the guiding sleeve 16 during its opening and closing phase. The wear of the suction valve member 10 at this region is considerably reduced by the provision of this guiding sleeve 16.

Figure 2:
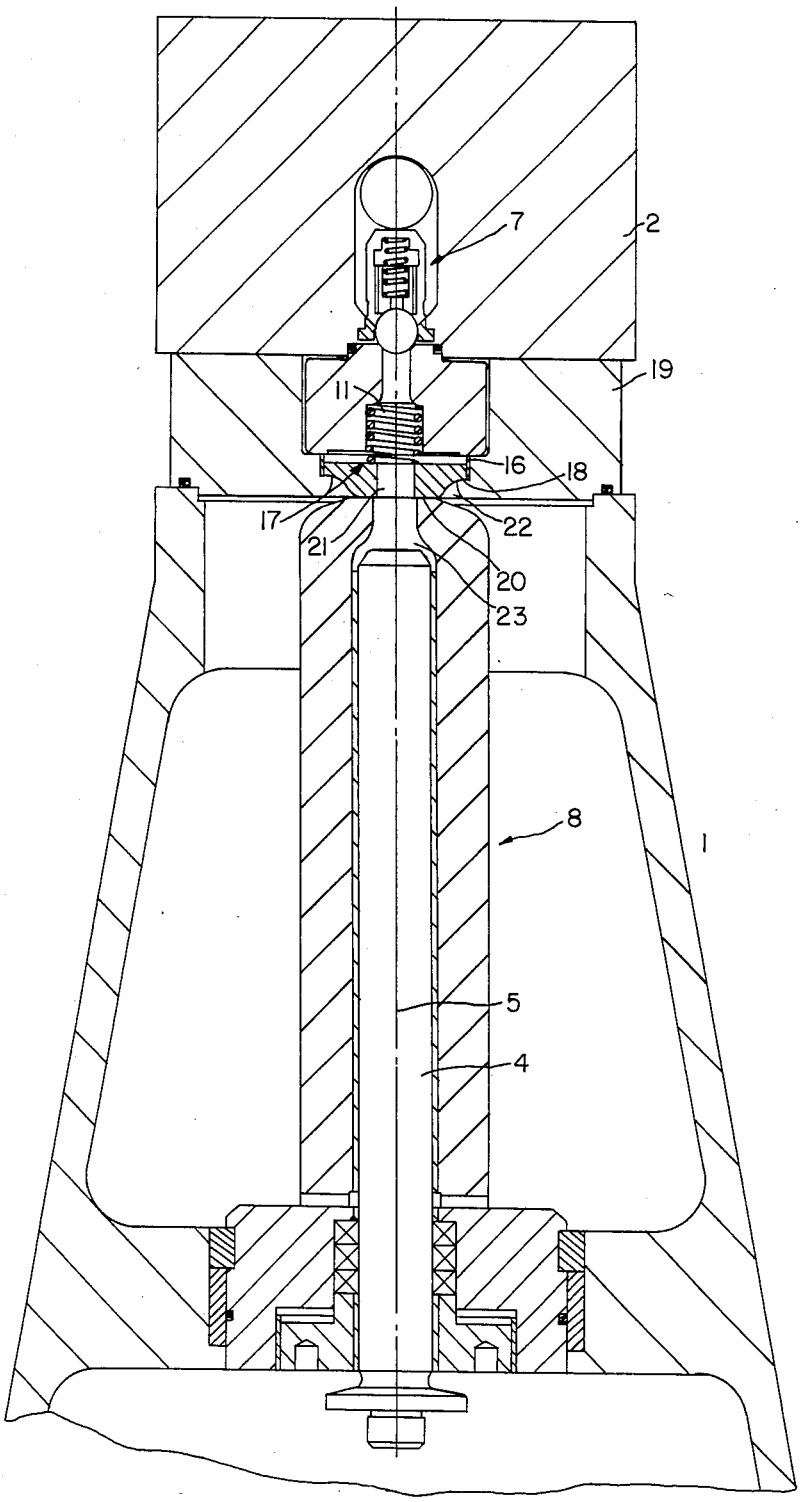
FIG. 2 is view similar to FIG. 1 but of a modified high-pressure plunger pump construction that is particularly suited for operation at high operating pressure and FIG. 3 is a large scale view of a detail of FIG. 1.
Figure 3:
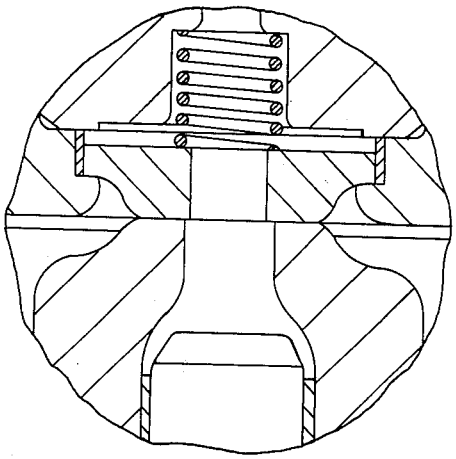

Turning now to FIG. 2 of the drawing, it is to be mentioned that it shows a modified construction of the high-pressure plunger pump embodying the present invention, which is similar to the construction described above in many respects so that the same reference numerals as before will be employed to identify corresponding parts, and which is designed for high working pressures. This plunger pump includes an annular suction valve body 17 having an annular surface 18 which rests against an annular seating surface of an insert body 19 and is offset in the longitudinal or axial direction of the suction valve member 17 with respect to an annular surface 20 which cooperates with the end face of the sleeve 8. The suction valve member 17 tapers from the annular surface 18 to the annular surface 20.

In order to keep the flow resistances when the suction valve is open low, the tapering region of the suction valve member 17 has an arcuate outer contour.

In the construction of the plunger pump of the present invention which is illustrated in FIG. 2 of the drawing, the structural height of the suction valve member 17 approximately corresponds to the diameter of its flow-through bore 21.

The sleeve 8 has, commencing at its end face, an S-shaped outer contour at the region of a suction channel 22 which is delimited by the sleeve 8 and the insert body 19. The insert body 19 is also rounded at the region of this suction channel 22, so that the flow resistances during the drawing in of the medium being pumped into a working space 23 which is formed by the sleeve 8 are kept low.

While the present invention has been described and illustrated herein as embodied in certain specific constructions of a high-pressure plunger pump, it is not limited to the details of such particular constructions, since various modifications and structural changes are possible and contemplated by the present invention. Thus, the scope of the present invention will be determined exclusively by the appended claims.

What is claimed is:

1. A high-pressure plunger pump, comprising a pump housing centered on an axis and including a main body having two axially spaced ends, and a pump head secured to one of said ends of said main body;

a plunger coaxially extending in said pump housing;

a sleeve floatingly supported on said plunger and having two end portions one of which is closer to said pump head than the other, converging toward said pump head and having an axial end face;

an insert body positionally secured in said pump housing and bounding a circumferentially extending annular suction channel with said one end portion of said sleeve, and including an annular shoulder having a substantially axially facing seating surface;

a pressure valve and a suction valve coaxially arranged within said housing, said suction valve being constructed as a plate valve including an annular plate-shaped member having an outer and an inner region and movable relative to said insert body and said sleeve between an open position and a closed position so that said annular plate-shaped member forms a suction valve member while said sleeve does not move to perform the function of a suction valve member, said outer and inner regions respectively sealingly contacting said annular shoulder of said inner body and said axial end face of said sleeve in said closed position, and spring means urging said suction valve member towards said closed position thereof.

2. The plunger pump as defined in claim 1, wherein said one end portion of said sleeve has a converging external surface; and wherein said insert body has an internal surface which bounds said suction channel with, and extends substantially parallel to, said external surface of said one end portion of said sleeve.

3. The plunger pump as defined in claim 1, wherein said suction valve member moves reciprocally in a predetermined reciprocation region between said open and closed positions thereof; and further comprising a guiding sleeve arranged in said insert body at said reciprocation region and slidingly contacted by said outer edge region of said suction valve member during the reciprocating movement thereof.

4. The plunger pump as defined in claim 3, wherein said guiding sleeve is of a material having a low coefficient of friction.

5. The plunger pump as defined in claim 1, wherein said inner and outer edge regions of said suction valve member have respective inner and outer contact surfaces which respectively contact said axial end face of said sleeve and said seating surface of said shoulder of said insert body, said inner contact surface being offset with respect to said outer contact surface in the axial direction of said suction valve body, and said suction valve body having a tapered region extending between said inner and outer contact surfaces.

6. The plunger pump as defined in claim 5, wherein said tapered region of said suction valve member has an arcuate outer contour.

7. The plunger pump as defined in claim 5, wherein said suction valve member has a flow-through opening having a predetermined diameter; and wherein said suction valve member has an axial dimension substantially corresponding to said predetermined diameter.

8. The plunger pump as defined in claim 5, wherein said one end portion of said sleeve has a substantially S-shaped configuration at said suction channel commencing at said axial end face thereof which cooperates with said suction valve member.

* * * * *